US005455597A

United States Patent [19]

Nakamura et al.

[11] Patent Number: 5,455,597

[45] Date of Patent: Oct. 3, 1995

[54] IMAGE-FORMING APPARATUS, AND DESIGNATION OF ELECTRON BEAM DIAMETER AT IMAGE-FORMING MEMBER IN IMAGE-FORMING APPARATUS

[75] Inventors: Naoto Nakamura, Isehara; Ichiro Nomura; Hidetoshi Suzuki, both of Atsugi; Yasue Sato, Kawasaki, all of Japan

[73] Assignee: Canon Kabushiki Kaisha, Tokyo, Japan

[21] Appl. No.: 172,060

[22] Filed: Dec. 23, 1993

[30] Foreign Application Priority Data

Dec. 29, 1992 [JP] Japan ..... 4-359796
Dec. 29, 1992 [JP] Japan ..... 4-361355

[51] Int. Cl.[6] ..... G09G 3/22

[52] U.S. Cl. ..... 345/75; 313/497

[58] Field of Search ..... 345/74, 75; 348/796

[56] References Cited

U.S. PATENT DOCUMENTS 4,956,578 9/1990 Shimizu et al. ..... 315/3

FOREIGN PATENT DOCUMENTS 0312007 4/1989 European Pat. Off. .
0404022 12/1990 European Pat. Off. .
58-1956 1/1983 Japan .
60-225342 11/1985 Japan .

OTHER PUBLICATIONS

Hisashi Araki, et al., "Electroforming and Electron Emission of Carbon Thin Films", Journal of the Vacuum Society of Japan, vol. 26, No. 1, pp. 22–29 (Sep. 24, 1981).

M. Hartwell, et al., "Strong Electron Emission from Patterned Tin–Indium Oxide Thin Films", International Electron Devices Meeting, pp. 519–521, (1975).

G. Dittmer, "Electrical Conduction and Electron Emission of Discontinuous Thin Films", Thin Solid Films, vol. 9, pp. 317–328 (Jul. 1971).

M. I. Elinson, et al., "The Emission of Hot Electrons and the Field Emission of Electrons from Tin Oxide", Radio Engineering and Electronic Physics, pp. 1290–1296 (Jul. 1965).

*Primary Examiner*—Jeffery Brier
*Attorney, Agent, or Firm*—Fitzpatrick, Cella, Harper & Scinto

[57] ABSTRACT

An image-forming apparatus is comprised of a substrate, an electron-emitting device which is provided on the substrate and includes an electron-emitting region between electrodes and emits electrons on application of voltage between the electrodes, and an image-forming member which forms an image on irradiation of an electron beam. A diameter $S_1$ of the electron beam on the image-forming member in direction of application of the voltage between the electrodes is given by Equation (I):

$$S_1=K_1\cdot 2d(V_f/V_a)^{1/2} \quad \text{(I)}$$

where $K_1$ is a constant and $0.8 \leqq K_1 \leqq 1.0$, d is a distance between the substrate and the image-forming member, $V_f$ is a voltage applied between the electrodes, and $V_a$ is a voltage applied to the image-forming member. A method for designing a diameter of an electron beam at an image-forming member face of the image-forming apparatus is comprised of a diameter $S_1$ the electron beam at the image-forming member face in a direction of application of the voltage between the electrodes designed so as to satisfy the equation (I).

35 Claims, 11 Drawing Sheets

IMAGE-FORMING APPARATUS, AND DESIGNATION OF ELECTRON BEAM DIAMETER AT IMAGE-FORMING MEMBER IN IMAGE-FORMING APPARATUS

BACKGROUND OF THE INVENTION

1. Field of the Invention

The present invention relates to an image-forming apparatus which forms an image by irradiation of an electron beam onto an image-forming member from an electron-emitting device. The present invention also relates to a method for setting (or designing) preliminarily the electron beam diameter on the image-forming member in production of the image forming apparatus.

2. Related Background Art

Flat panel display apparatus practically used includes liquid crystal display apparatus, EL display apparatus, and plasma display panels. These are not satisfactory for image displaying in view of the visual field angle, displayed colors, luminance, and so forth. In particular, the flat panel display apparatus are inferior to cathode ray tubes (CRT) in the displaying characteristics, and cannot be used as a substitute for the CRT at present.

However, with the progress of information processing by computers, and with the improvement in image quality in TV broadcasting, demands are increasing for the flat panel display apparatus of high definition and large display size.

To meet the demands, Japanese Patent Appln. Laid-Open Nos. 58-1956 and 60-225342 disclose flat panel image forming device which comprises a plurality of electron sources arranged in one plane and fluorescent targets counterposed thereto for receiving an electron beam respectively from the electron sources.

These electron beam display apparatuses have a structure shown below. FIG. 11 illustrates schematically an apparatus constituting a conventional display apparatus. The apparatus comprises a glass substrate 71, supports 72, electron-emitting regions 73, wiring electrodes 74, electron passage holes 14, modulation electrodes 15, a glass plate 5, a transparent electrode 6, and an image-forming member 7. The image-forming member is made of a material which emits light, changes its color, becomes electrically charged, or is denatured on collision of electrons, e.g., a fluorescent material, a resist material, etc. The glass plate 5, the transparent electrode 6 and the image-forming member 7 constitute a face plate 8. The numeral 9 denotes luminous spots of the fluorescent member. The electron-emitting region 73 is formed by a thin film technique and has a hollow structure without contacting the glass plate 71. The wiring electrode may be made of the same material as the electron-emitting region or a different material therefrom, and has generally a high melting point and a low electric resistance. The support 72 may be made of an insulating material or of an electroconductive material.

In such an electron beam display apparatus, a voltage is applied to the wiring electrodes to emit electrons from the electron-emitting regions 73, the electrons are derived by applying a voltage to the modulation electrodes 15 which conduct modulation in accordance with information signals, and the derived electrons are accelerated to collide against the fluorescent member 9. The wiring electrodes and the modulation electrodes are arranged in an X–Y matrix to display an image on the image forming member 7.

The aforementioned electron beam displaying apparatus, which uses a thermoelectron source, has disadvantages of (1) high power consumption, (2) difficulty in display of a large quantity of images because of low modulation speed, and (3) difficulty in display of large area because of variation among the devices.

An image-forming apparatus having arrangement of surface conduction electron-emitting devices in place of the thermoelectron source is expected to offset the above disadvantages.

The surface conduction electron-emitting device emits electrons with a simple structure, and is exemplified by a cold cathode device disclosed by M. I. Elinson, et al. (Radio Eng. Electron Phys. Vol. 10, pp. 1290–1296 (1965)). This device utilizes the phenomenon that electrons are emitted from a thin film of small area formed on a substrate on application of electric current in a direction parallel to the film face.

The surface conduction electron-emitting device, in addition to the above-mentioned one disclosed by Elinson et al. employing $SnO_2$(Sn) thin film, includes the one employing an Au thin film (G. Dittmer: "Thin Solid Films", Vol. 9, p. 317 (1972)), the one employing an ITO thin film (M. Hartwell, and C. G. Fonstad: "IEEE Trans. ED Conf.", p. 519 (1975)), the one employing a carbon thin film (H. Araki et al.: "Sinkuu (Vacuum)", Vol. 26, No. 1, p. 22 (1983)), and so forth.

These surface conduction electron-emitting devices have advantages of (1) high electron emission efficiency, (2) simple structure and ease of production, (3) possibility of arrangement of a large number of devices on one substrate, (4) high response speed, and so forth, and are promising in many application fields.

FIG. 12 illustrates construction of an image forming device employing such a surface conduction electron-emitting device in an use for image forming apparatus. The device comprises an insulating substrate 1, device electrodes 2, 3, and electron-emitting regions 4.

In this image-forming apparatus employing the surface conduction electron-emitting devices also, an image is formed by application of a voltage through device wiring electrodes 81 between the device electrodes 2, 3 to emit electrons and by control of the intensity of the electron beam projected to a fluorescent member 7 by applying a voltage to modulation electrodes 15 corresponding to information signals.

As well known, when a planar target is placed in opposition to a thermoelectron source and electrons are accelerated by application of a positive voltage to the target, the electron beam collides against the target in a form corresponding nearly to the shape of the electron source. Accordingly, in an image-forming apparatus employing thermoelectron sources as shown in FIG. 11, the shape of the electron beam spot formed on the image-forming member can readily be controlled by suitably designing the shape of the electron sources. However, the image-forming apparatus employing thermoelectron sources has disadvantages mentioned above and cannot meet satisfactorily the demand for high picture qualities and a large picture size.

On the other hand, the surface conduction electron-emitting device which has the aforementioned advantages is expected to enable the construction of image-forming apparatus which satisfies the above demands. In the surface conduction electron-emitting device, a voltage is applied to the electrodes connected to a thin film in the direction parallel to the substrate surface to flow an electric current in a direction parallel to the thin film formed on the substrate, whereby electrons are emitted. The emitted 10 electrons are affected by the electric field generated by the applied voltage. Thereby the electrons are deflected toward the higher potential electrode, or the trajectory of electrons is distorted before the electrons reach the face of the image-forming member. Therefore, the shape and the size of the electron beam spot on the image-forming member cannot readily be predicted. It is extremely difficult to decide the application voltage ($V_f$) to the electron-emitting device, the electron beam acceleration voltage ($V_a$) applied to the image-forming member, the distance (d) between the substrate and the image-forming member, and so forth.

Since the electron beam is subjected to the aforementioned deflecting action during projection onto the image-forming member, the shape of the electron beam spot on the image-forming member will be deformed or distorted, so that a spot in an axial symmetry, like a circle, cannot readily be obtained.

SUMMARY OF THE INVENTION

An object of the present invention is to provide an image-forming apparatus which is capable of forming a sharp image with improved symmetry of the shape of the electron beam spot with improved image resolution without deformation.

Another object of the present invention is to provide an image forming apparatus having surface conduction electron-emitting devices or similar devices which emit electrons by applying voltage between planar electrode pairs on a substrate, in which the size of the electron beam spot can be determined by the voltage applied to the device, the electron acceleration voltage, the distance between the device and the image-forming member, and other factors.

According to an aspect of the present invention, there is provided an image-forming apparatus having a substrate, an electron-emitting device which is provided on the substrate, has an electron-emitting region between electrodes, and emits electrons on application of voltage between the electrodes, and an image-forming member which forms an image on irradiation of an electron beam. The diameter $S_1$ of the electron beam on the image-forming member in a direction of application of the voltage between the electrodes is given by Equation (I):

$$S_1=K_1\cdot 2d(V_f/V_a)^{1/2} \quad \text{(I)}$$

where $K_1$ is a constant and $0.8\leqq K_1\leqq 1.0$, d is a distance between the substrate and the image-forming member, $V_f$ is a voltage applied between the electrodes, and $V_a$ is a voltage applied to the image-forming member.

According to another aspect of the present invention, there is provided an image-forming apparatus as mentioned above which has a plurality of the electron-emitting devices, wherein distance D in a voltage application direction between the plurality of electron emitting regions as mentioned above of the device satisfies Equation (II):

$$K_2 2d(V_f/V_a)^{1/2} D/2\leqq K_3\cdot 2d(V_f/V_a)^{1/2} \quad \text{(II)}$$

According to another aspect of the present invention, there is provided an image-forming apparatus having a substrate, an electron-emitting device which is provided on the substrate, has an electron-emitting region between electrodes, and emits electrons on application of voltage between the electrodes, and an image-forming member which forms an image on irradiation of an electron beam. A diameter $S_2$ of the electron beam on the image-forming member perpendicular to the direction of application of the voltage between the electrodes being given by Equation (III):

$$S_2=L+2K_4\cdot 2d(V_f/V_a)^{1/2} \quad \text{(III)}$$

where $K_4$ is a constant and $0.8\leqq K_4\leqq 0.9$, d is a distance between the substrate and the image-forming member, L is the length of the electron-emitting region perpendicular to the direction of voltage application, $V_f$ is a voltage applied between the electrodes, and $V_a$ is a voltage applied to the image-forming member.

According to still another aspect of the present invention, there is provided an image-forming apparatus having a substrate, a plurality of electron-emitting devices which are provided on the substrate, have an electron-emitting region between electrodes, and emit electrons on application of voltage between the electrodes, and an image-forming member which forms an image on irradiation of an electron beam. The electron-emitting devices are arranged at an arrangement pitch P in a direction perpendicular to voltage application between the electrodes, and the pitch P satisfies Equation (IV):

$$P<L+2K_5\cdot 2d(V_f/V_a)^{1/2} \quad \text{(IV)}$$

where $K_5=0.80$, d is a distance between the substrate and the image-forming member, L is the length of the electron-emitting region perpendicular to the direction of voltage application, $V_f$ is a voltage applied between the electrodes, and $V_a$ is a voltage applied to the image-forming member.

According to a further aspect of the present invention, there is provided an image-forming apparatus having a substrate, a plurality of electron-emitting devices which are provided on the substrate, have an electron-emitting region between electrodes, and emit electrons on application of voltage between the electrodes, and an image-forming member which forms an image on irradiation of an electron beam. The electron-emitting devices are arranged at an arrangement pitch P in a direction perpendicular to voltage application between the electrodes, and the pitch P satisfies Equation (V):

$$P\geqq L+2K_6\cdot 2d(V_f/V_a)^{1/2} \quad \text{(V)}$$

where $K_6=0.90$, d is a distance between the substrate and the image-forming member, L is the length of the electron-emitting region perpendicular to the direction of voltage application, $V_f$ is a voltage applied between the electrodes, and $V_a$ is a voltage applied to the image-forming member.

According to a still further aspect of the present invention, there is provided a method for designing a diameter of an electron beam at an image-forming member of an image-forming apparatus having a substrate, an electron-emitting device which is provided on the substrate, has an electron-emitting region between electrodes, and emits electrons on application of voltage between the electrodes, and an image-forming member which forms an image on irradiation of an electron beam. A diameter $S_1$ of the electron beam at the image-forming member in a direction of application of the voltage between the electrodes is designed so as to satisfy Equation (I):

$$S_1=K_1\cdot 2d(V_f/V_a)^{1/2} \quad \text{(I)}$$

where $K_1$ is a constant and $0.8\leqq K_1\leqq 1.0$, d is a distance between the substrate and the image-forming member, $V_f$ is a voltage applied between the electrodes, and $V_a$ is a voltage applied to the image-forming member.

According to a still further aspect of the present invention, there is provided a method for designing a diameter of an electron beam at an image-forming member of an image-forming apparatus having a substrate, an electron-emitting device which is provided on the substrate, has an electron-emitting region between electrodes, and emits electrons on application of voltage between the electrodes, and an image-forming member which forms an image on irradiation of an electron beam. A diameter $S_2$ of the electron beam at the image-forming member face perpendicular to the direction of application of the voltage between the electrodes is designed so as to satisfy Equation (III):

$$S_2=L+2K_4\cdot 2d(V_f/V_a)^{1/2} \quad \text{(III)}$$

where $K_4$ is a constant and $0.8 \leqq K_4 \leqq 0.9$, d is a distance between the substrate and the image-forming member, L is the length of the electron-emitting region perpendicular to the direction of voltage application, $V_f$ is a voltage applied between the electrodes, and $V_a$ is a voltage applied to the image-forming member.

DETAILED DESCRIPTION OF PREFERRED EMBODIMENT

The technical background and effects of the present invention are described below in detail with reference to the drawings.

Figure 1:
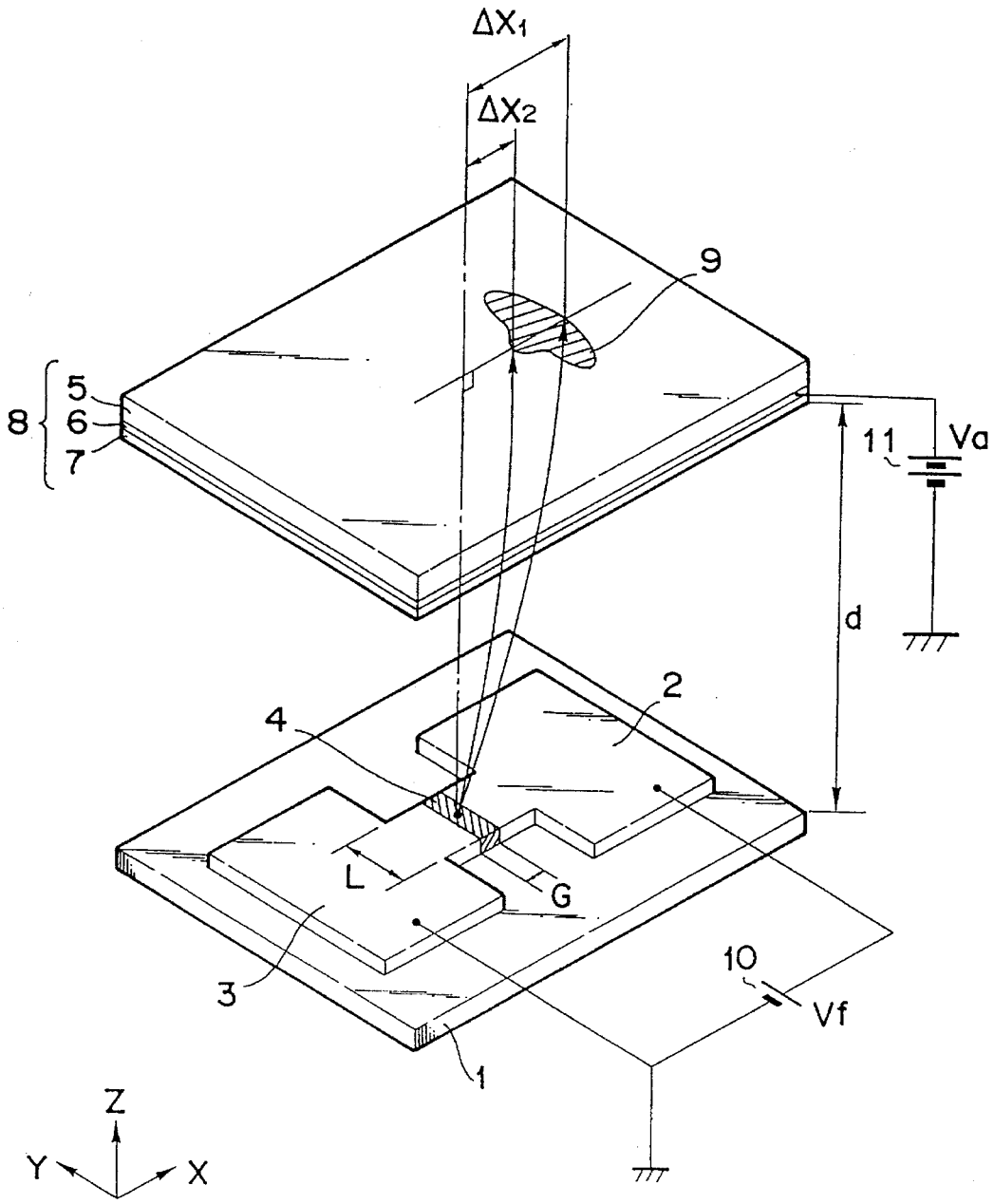
FIG. 1 is a schematic perspective view illustrating a picture device construction of an image-forming apparatus in Example 1 of the present invention.

FIG. 1 is a schematic perspective view illustrating construction of a picture device of an image forming apparatus unit employing a surface conduction electron-emitting device as an electron source and also illustrating electron trajectory therein.

In FIG. 1, the surface conduction electron-emitting device comprises an insulating substrate 1, a high potential device electrode 2, a low potential device electrode 3, and an electron-emitting region 4. The two electrodes 2, 3 are formed with a narrow gap on the substrate 1, and the electron-emitting region 4 constituted of a thin film is formed at the gap. The face plate 8 is placed in opposition to the device substrate to construct the image forming apparatus. The face plate 8 is constituted of a glass plate 5, a transparent electrode 6, an image forming member 7 (a fluorescent member in this example), and is placed above the insulating substrate 1 at a distance "d".

In the above constitution, when a voltage $V_f$ is applied by a device-driving power source 10 between the device electrodes 2, 3, electrons are emitted from the electron-emitting region 4. The emitted electrons are accelerated by acceleration voltage $V_a$ applied by an electron beam-accelerating power source 11 through the transparent electrode 6 to the fluorescent member 7, and collide against the fluorescent member 7 to form a luminous spot 9 on the face plate 8.

Figure 2:
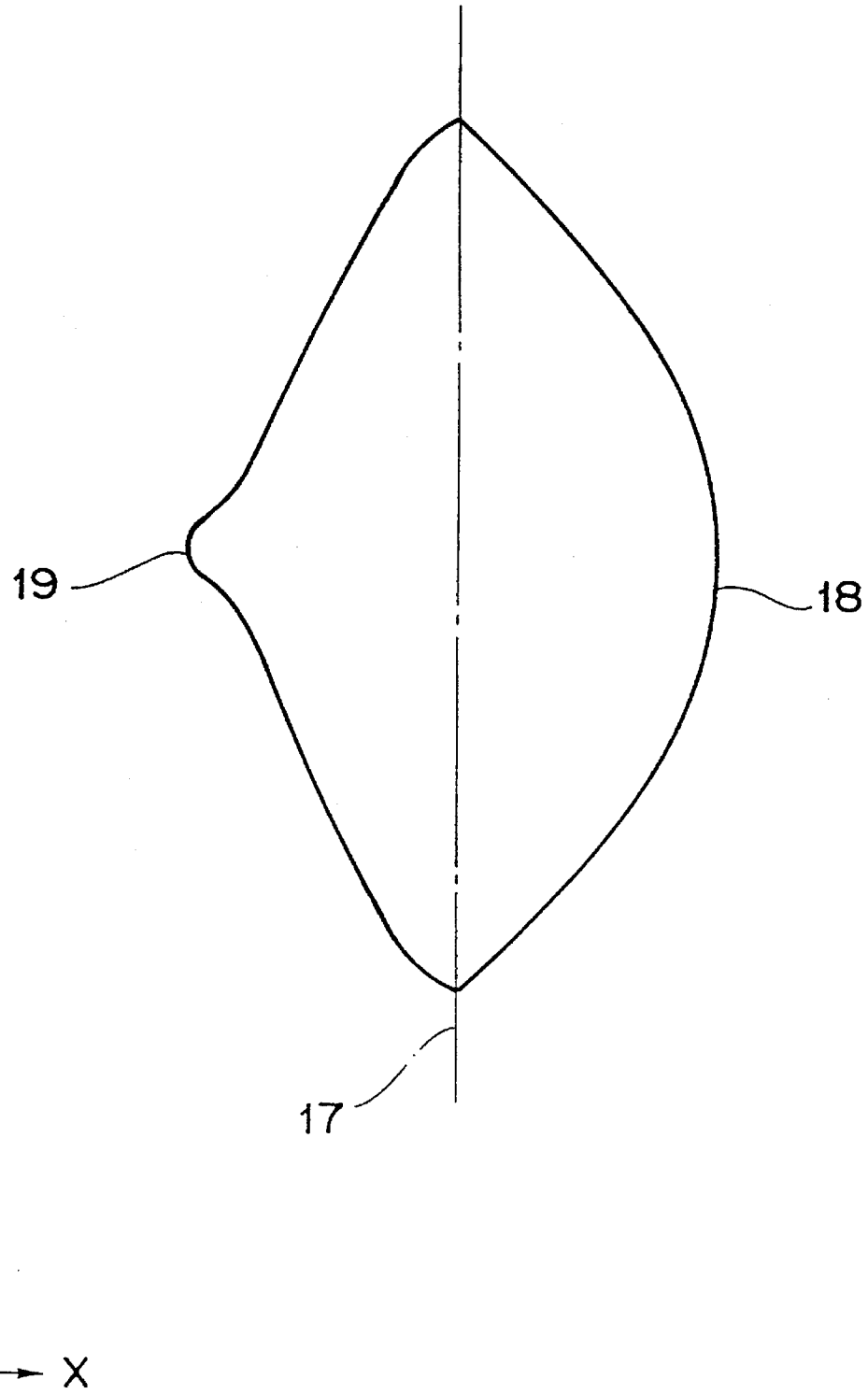
FIG. 2 illustrates the shape of the luminous spot observed in Example 1.

FIG. 2 is an enlarged schematic diagram of the luminous spot 9 observed on the fluorescent member in the apparatus shown in FIG. 1. The numeral 17 denotes a center axis.

As shown in FIG. 2, the entire luminous spot is observed to spread in the direction of the voltage application in the device electrodes (X direction in the drawing) and in the direction perpendicular thereto (Y direction in the drawing).

The reason why such a luminous spot is formed or why the electron beam reaches the image-forming member with a certain spread is not clear, since the electron-emission mechanism of the surface conduction electron-emitting device is not completely elucidated. It is presumed by the inventor of the present invention that electrons are emitted at a certain initial velocity in all directions, on the basis of many experiments.

It is also presumed by the inventor of the present invention that the electrons emitted in a direction tilting to the high potential electrode side (plus X direction in the drawing) reach the tip portion 18 of the luminous spot, and the electrons emitted in a direction tilting to the low potential electrode side (minus X direction in the drawing) reach the tail portion 19 of the luminous spot. Thus, the spread of the spot in the X direction is caused by emission of electrons with emission angle distribution relative to the substrate face. It is estimated that the amount of electrons emitted to the low potential electrode direction is much less because the luminance is lower at the tail portion than in other portions.

In FIGS. 1 and 2, the luminous spot 9 deviates from the direction perpendicular to the electron-emitting region 4 to the plus X direction, i.e., to the side of high potential device electrode 2, according to experiments conducted by the inventors of the present invention. This is probably due to the fact that, in the field above the surface conduction electron-emitting device, the equipotential surfaces are not parallel to the image-forming member 7 in the vicinity of the electron-emitting region, and the emitted electrons are not only accelerated by the acceleration voltage $V_a$ in Z direction in the drawing but also accelerated toward the high potential device electrode. That is, the electrons, immediately after they are emitted, are unavoidably subjected to deflecting action of the applied voltage $V_a$ which is necessary for electron emission.

As the results of detailed studies on the shape and the size of the luminous spot 9 and the positional deviation of the luminous spot 9 to the X direction, from the direction perpendicular to the electron emitting region 4 it was tried to represent the deviation distance to the tip of the luminous spot ($\Delta X_1$ in FIG. 1) and the deviation distance to the tail of the luminous spot ($\Delta X_2$ in FIG. 1) as functions of $V_a$, $V_f$, and d.

The case is considered where a target is placed in a Z direction above an electron source at a distance d, a voltage of $V_a$ volts is applied to the target, and a uniform electric field exists between the electron source and the target. An electron emitted at an initial velocities of V (eV) in the X direction and zero in Z direction deviates by a distance $\Delta X$ shown below in the X direction according to the equation of motion:

$$\Delta X=2d(V/V_a)^{1/2} \quad (1)$$

As the results of experiments conducted by the present inventors, it can be assumed that the electron is accelerated in the X direction in only the vicinity of 10 the electron emitting region and thereafter the velocity in the X direction is approximately constant since the voltage applied to the image-forming member is much higher than that applied to the electron-emitting device although the electron may be accelerated somewhat in the X direction by the distorted electric field in the vicinity of the electron-emitting region. Therefore the deviation of the electron beam in the X direction will be obtained by substituting the velocity after the acceleration near the electron-emitting region for V in the equation (1).

If C (eV) is the velocity component of the electron in the X direction after the acceleration in the X direction in the vicinity of the electron-emitting region, C is a constant which depends on the voltage $V_f$ applied to the device. The constant C as a function of $V_f$ is represented by $C(V_f)$ (unit: eV). By substituting $C(V_f)$ for V in the equation (1), the deviation $\Delta X_0$ is shown by Equation (2) below:

$$\Delta X_0=2d\{C(V_f)/V_a)^{1/2} \quad (2)$$

Equation (2) represents the distance of deviation of the electron which is emitted from the electron-emitting region at an initial velocity of zero in the X direction and is accelerated by the voltage $V_f$ applied to the device to gain a velocity of C (eV) in the X direction in the vicinity of the electron-emitting region.

In practice, however, in the surface conduction type electron-emitting device, the electrons are considered to be emitted at a certain initial velocity in all directions. Let the initial velocity be $v_0$(eV), then from Equation (1), the largest deviation of the electron beam in the X direction is:

$$\Delta X_1=2d\{(C+v_0)/V_a\}^{1/2} \quad (3)$$

and the smallest deviation of the electron beam in the X direction is:

$$\Delta X_2=2d\{(C-v_0)/V_a\}^{1/2} \quad (4)$$

Here, the initial velocity $v_0$ is also a constant which depends on the voltage energy $V_f$ applied to the electron-emitting region. By use of constants $K_2$ and $K_3$, $$\{(C+v_0)(V_f)\}^{1/2}=K_2(V_f)^{1/2},$$

and $$\{(C+v_0)(V_f)\}^{1/2}=K_3(V_f)^{1/2}$$

Therefore Equations (3) and (4) are modified with the above equations as below:

$$\Delta X_1=K_2\cdot 2d(V_f/V_a)^{1/2} \quad (5),$$

and $$\Delta X_2=K_3\cdot 2d(V_f/V_a)^{1/2} \quad (6)$$

where the values of d, $V_f$, and $V_a$ is measurable, and $\Delta X_1$ and $\Delta X_2$ are also measurable.

$\Delta X_1$, and $\Delta X_2$ were measured in many experiments by varying the values of d, $V_f$, and $V_a$ in FIG. 1, and consequently the values of $K_2$ and $K_3$ below were obtained:

$$K_2=1.25\pm0.05,$$

and $$K_3=0.35\pm0.05$$

These are valid especially in the cases where the intensity of the accelerating electric field ($V_a$/d) is 1 kV/mm or higher.

On the basis of the above findings, easily obtainable is the dimension ($S_1$) of the electron beam spot on the image-forming member in the voltage application direction at the electron-emitting devices (X direction) as the difference of $\Delta X_1$ and $\Delta X_2$, namely $S_1=\Delta X_1-\Delta X_2$.

Let $K_1=K_2-K_3$, then from equations (5) and (6), $$S_1=K_1\cdot 2d(V_f/V_a)^{1/2} \quad (7)$$

where $0.8\leqq K_1\leqq 1.0$.

Figure 6:
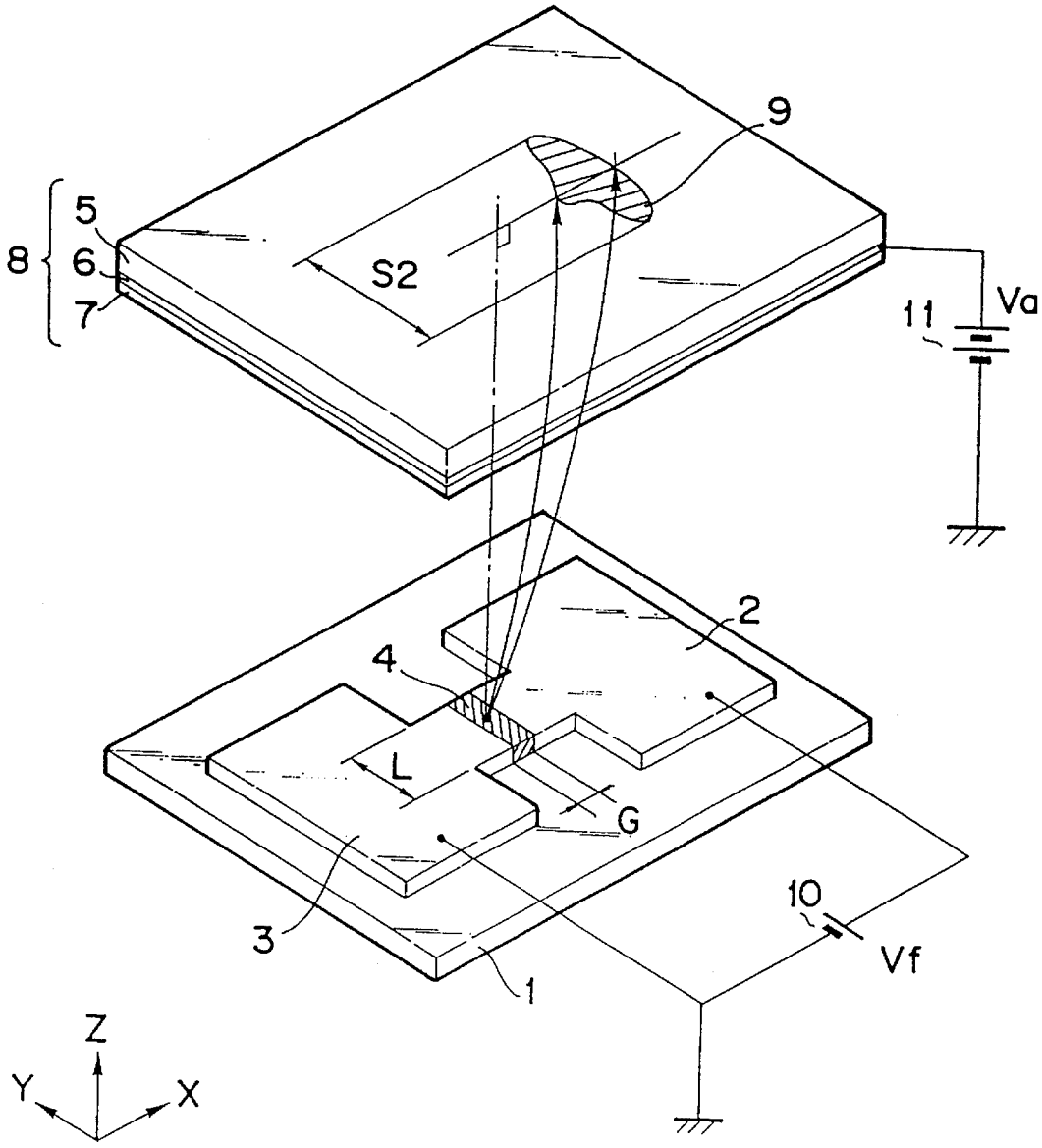
FIG. 6 is a perspective view for explaining an image-forming apparatus in Example 3 of the present invention.

Next, the spot size in the direction perpendicular to the voltage application direction in the electron-emitting device is considered. By similar consideration as above, the electron beam is considered to be emitted at the initial velocity of $v_0$ also in the direction perpendicular to the voltage application direction in the electron-emitting device (in the Y direction in FIG. 6). As shown in FIG. 6, the electron beam is accelerated only a little in the Y direction after the emission. Therefore, the deviations of the electron beam in the plus Y direction and the minus Y direction are both considered to be as below:

$$\Delta Y=2d(v_0/V_a)^{1/2} \quad (8)$$

From Equations (3) and (4), $$\{(\Delta X_1^2-\Delta X_2^2)/2\{^{1/2}=2d(v_0/V_a)^{1/2} \quad (9)$$

From Equations (5) and (6), $$\{(\Delta X_1^2-\Delta X_2^2)/2\}^{1/2}=2d(V_f/V_a)^{1/2}\cdot\{(K_2^2-K_3^2)/2\}^{1/2} \quad (10)$$

By comparison of Equation (9) with Equation (10), $$2d(v_0/V_a)^{1/2}=2d(V_f/V_a)^{1/2}\cdot\{(K_2^2-K_3^2)/2\}^{1/2} \quad (11)$$

Let $K_4=\{(K_2^2-K_3^2)/2)^{1/2}$on the right side of Equation (11), then the dimension ($S_2$) of the electron beam spot on the image-forming member in the Y direction is represented by the equation below:

$$\begin{aligned} S_2 &= L + 2\Delta Y \\ &= L + 2K_4\cdot 2d(V_f/V_a)^{1/2} \end{aligned} \quad (12)$$

where L is the length of the electron-emitting region in the Y direction.

In Equation (12), the values of d, $V_f$, $V_a$, and L are measurable. Therefore, the coefficient $K_4$ is decided by measuring $S_2$ experimentally. On the other hand, $K_2=1.25\pm0.05$ and $K_3=0.35\pm0.05$, therefore $$.80 \leqq K_4 \leqq 0.90$$

according to the definition of $K_4$. The value of $K_4$ obtained from the experimentally determined spot dimension in the Y direction fell in the above $K_4$ range.

The inventors of the present invention considered the relations of electron beams emitted from a plurality of electron-emitting regions on the image-forming member on the basis of the above Equations.

Figure 3:
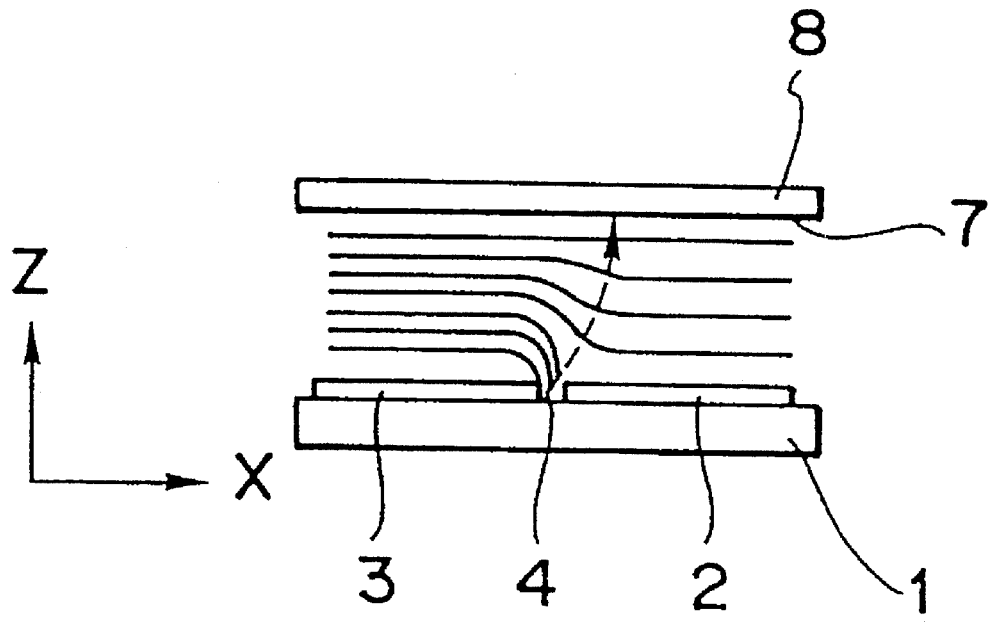
FIG. 3 illustrates the projection state of an electron beam in an image-forming apparatus employing a surface conduction electron-emitting device.

In the construction shown in FIG. 1, the emitted electrons reach the image-forming member in an asymmetric shape relative to the X-axis as shown in FIG. 2 owing to the distortion of the electric field in the vicinity of the device electrodes (FIG. 3), the effect of the electrode edge, and other factors. The distortion and the asymmetry of the spot shape will decrease the resolution of the image, causing low decipherability of letters and unsharpness of animations.

In this case, the luminous spot is in a shape asymmetric to the X-axis, but the deviations of the tip portion and the tail portion are known from Equations (5) and (6). Accordingly, it has been found by the inventors of the present invention that a plurality of electron-emitting regions formed at a distance D on both sides of the high potential electrode of the device electrodes gives a luminous spot in satisfactory symmetric shape by the electron beams falling onto one spot on the image-forming member.

$$K_2 \cdot 2d(V_f/V_a)^{1/2} \geqq D/2 \geqq K_3 \cdot 2d\,(V_f V_a)^{1/2} \tag{13}$$

where $K_2$ and $K_3$ are constants and $$K_2=1.25\pm0.05,$$

and $$K_3=0.35\pm0.05.$$

When the luminous spots are required to be joined together also in the direction perpendicular to the voltage application direction (namely in the Y direction), the arrangement pitch P in the Y direction of the electron-emitting devices having electron-emitting regions of the length L in the Y direction is designed to satisfy Equation (14) below similarly as in the case for the X direction:

$$P<L+2K_4 \cdot 2d(V_f/V_a)^{1/2} \tag{14}$$

where $K_4=0.80$.

On the contrary, when the luminous spots formed by electrons emitted from electron-emitting regions of the length L in the Y direction are required to be separated from each other in the Y direction, the arrangement pitch P of the electron-emitting devices in the Y direction is designed to satisfy Equation (15) below:

$$P \geqq L+2K_5 \cdot 2d(V_f/V_a)^{1/2} \tag{15}$$

where $K_5=0.90$.

The present invention is described specifically below by reference to examples.

EXAMPLE 1

An image-forming apparatus was produced according to the present invention. FIG. 1 is a schematic perspective view illustrating a construction of one picture device of the image forming apparatus of the present invention. FIG. 2 is a magnified drawing of one luminous spot.

A method of production of the image-forming apparatus is described below.

Firstly, an insulating substrate 1 made of a glass plate was washed sufficiently. On this substrate 1, a high potential device electrode 2 and a low potential device electrode 3 were formed from nickel and chromium respectively in a thickness of 0.1 μm by conventional vapor deposition, photolithography, and etching. The device electrodes may be made of any material provided that the electric resistance thereof is sufficiently low. The formed device electrodes had an electrode gap of 2 μm wide. Generally, the gap is preferably in a width of from 0.1 μm to 10 μm.

Secondly, a fine particle film was formed as an electron-emitting region 4 at the gap portion by a gas deposition method. In this Example, palladium was employed as the material for the fine particles. Another material may be used therefor, the preferred material including metals such as Ag and Au; and oxides such as $SnO_2$ and $In_2O_3$, but are not limited thereto. In this Example, the diameter of the Pd particles formed was about 100 Å. However, the diameter is not limited thereto. The fine particle film having desired properties may be formed, for example, by application of a dispersion of an organic metal and subsequent heat treatment. The length L of the electron-emitting region was 150 μm in this Example.

Thirdly, a face plate 8 was prepared by vapor-depositing a transparent electrode 6 of ITO on the one face of the glass plate 5, and thereon providing an image-forming member (a fluorescent member 7 in this Example) by a printing method or a precipitation method. The face plate 8 was fixed by a supporting frame (not shown in the drawing) at a distance of 3 mm above the substrate 1 having electron-emitting devices to produce an image-forming apparatus of the present invention.

In the image-forming apparatus produced above, electrons were emitted by application of a driving voltage $V_f$ of 14 V from a device driving power source 10 between device electrodes of the electron-emitting device such that a higher potential is applied to the high potential device electrode. Simultaneously, an accelerating voltage of 6 kV was applied from an electron beam accelerating power source 11 through the transparent electrode 6 to the fluorescent member 7.

When electrons are emitted by application of the voltage as above calculation can be made, on the basis of the aforementioned approximate Equation (7), as to the distance between the top portion and the tail portion of the luminous spot on the fluorescent member 7, namely the dimension of the spot in the X direction:

$$\begin{aligned} S_1 &= \Delta X_1 - \Delta X_2 \\ &= K_1 \times 2 \times 3.0\ (\text{mm}) \times (14/6000)^{1/2} \end{aligned} \tag{16}$$

Here $0.8 \leqq K_1 \leqq 1.0$, therefore $0.232\ (\text{mm}) \leqq S_1 \leqq 0.290\ (\text{mm})$.

Practically, as the results of visual examination of the formed spot by a microscope with magnification of 50×, the spot size $S_1$ in the X direction was found to be about 260 μm, which agrees with the calculated value from Equation (16).

EXAMPLE 2

Figure 4:
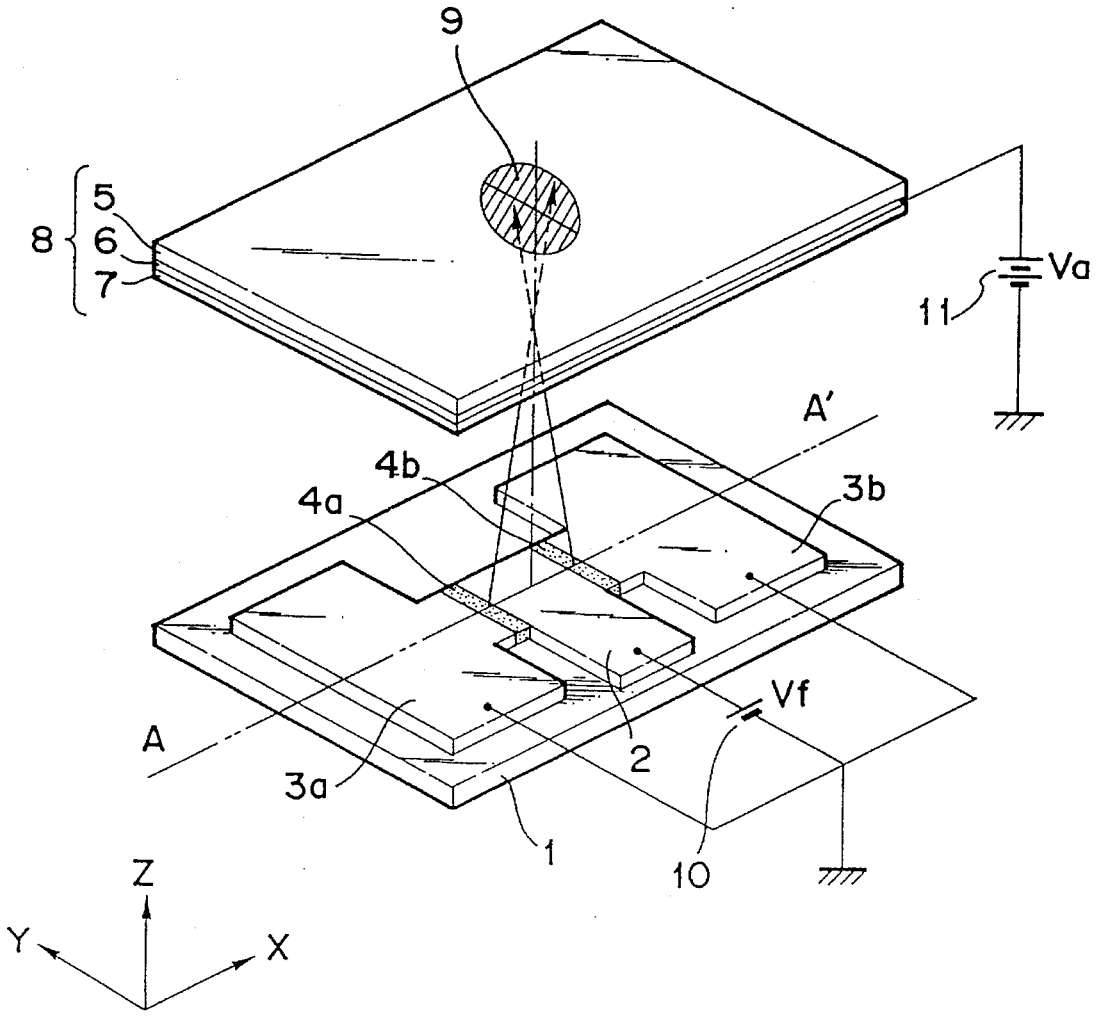
FIG. 4 is a perspective view illustrating constitution of a picture device of an image-forming apparatus in Example 2 of the present invention.

An image-forming apparatus was produced according to the present invention. FIG. 4 is a schematic perspective view illustrating a construction of one picture device of the image forming apparatus of the present invention. FIG. 4 is a magnified sectional view of the electron-emitting device of FIG. 4 taken along the plane A–A'.

A method of production of the image-forming apparatus is described below.

Figure 5:
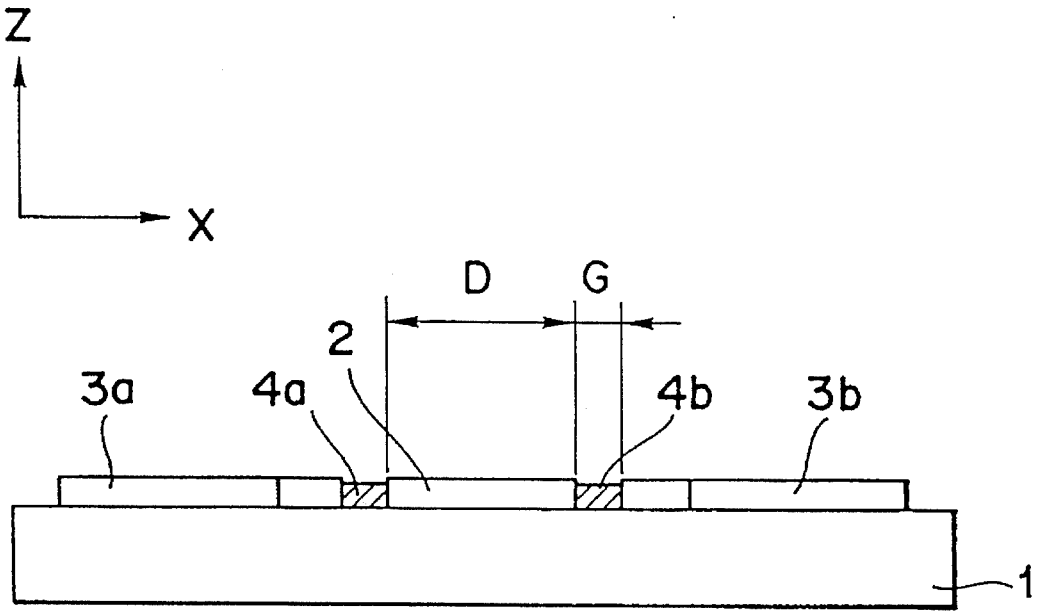
FIG. 5 is an enlarged sectional view of the electron emitting device taken along the plane A–A' in FIG. 4.

Firstly, an insulating substrate 1 made of a glass plate was washed sufficiently. On this substrate 1, a high potential device electrode 2 and a low potential device electrodes 3*a*, 3*b* were formed from nickel and chromium respectively in a thickness of 0.1 μm by conventional vapor deposition, photolithography, and etching. The device electrodes 2, 3*a*, 3*b* may be made of any material provided that the electric resistance thereof is sufficiently low. In this Example, the device electrodes 2, 3*a*, 3*b* were made to have two gaps of 2 μm wide (G in FIG. 5). Generally, the gaps are preferably in a width of from 0.1 μm to 10 μm.

Secondly, fine particle films were formed as electron-emitting regions 4*a*, 4*b* at the gap portions by a gas deposition method. In this Example, palladium was employed as the material for the fine particles. Another material may be used therefor, the preferred material including metals such as Ag and Au; and oxides such as $SnO_2$ and $In_2O_3$, but are not limited thereto. In this Example, the diameter of the Pd particles formed was about 100 Å. However, the diameter is not limited thereto. The fine particle film having desired properties may be formed, for example, by application of a dispersion of an organic metal and subsequent heat treatment. The length of the electron-emitting region in the Y direction was 150 μm, and the width of the high potential device electrode 2 (D in FIG. 5) was 400 μm in this Example.

Thirdly, a face plate 8 was prepared by vapor-depositing a transparent electrode 6 of ITO on the one face of the glass plate 5, and thereon providing an image-forming member (a fluorescent member 7 in this Example) by a printing method or a precipitation method. The face plate 8 was fixed by a supporting frame (not shown in the drawing) at a distance of 3.0 mm above the substrate 1 having electron-emitting devices to produce an image-forming apparatus of the present invention.

In the image-forming apparatus produced above, electrons were emitted by application of a driving voltage $V_f$ of 14 V from a device driving power source 10 between device electrodes of the electron-emitting device such that a higher potential is applied to the high potential device electrode. Simultaneously, an accelerating voltage of 6 kV was applied from an electron beam accelerating power source 11 through the transparent electrode 6 to the fluorescent member 7.

When electrons are emitted by application of the voltage as above, the deviations of the electrons reaching the fluorescent member 7 from the electron-emitting region 4*a* in plus X direction, and from the electron-emitting region 4*b* in the X minus direction are within the range between the maximum value of $\Delta X_1$ and the minimum value of $\Delta X_2$ calculated according to the aforementioned approximate Equations (5) and (6).

From Equations (5) and (6), $$\begin{aligned} \Delta X_{1\,max} &= 1.30 \times 2 \times 3.0\ (\text{mm}) \times (14/6000)^{1/2} \\ &= 0.377\ (\text{mm}) \\ \Delta X_{2\,min} &= 0.30 \times 2 \times 3.0\ (\text{mm}) \times (14/6000)^{1}/2 \\ &= 0.023\ (\text{mm}) \end{aligned}$$

Therefore, the deviation of the center is:

$$(377+23)/2=200\ (\mu\text{m})$$

Since the width D of the high potential electrode is 400 μm, the center of the luminous spot is nearly at a position in the direction perpendicular to the center of the high potential electrode (D/2=200 μm). Therefore the center portions of the electron beam spots emitted from the electron-emitting regions 4*a*, 4*b* come to be superposed.

In practical experiment, the two electron beam spots were superposed to give a symmetrical (approximately ellipsoidal) beam spot (X: 350 μm, Y: 650 μm.

As shown in this Example, the formed spot is in a symmetrical shape, and distinctness and sharpness of the displayed image are improved when a plurality of electron-emitting devices is provided at a distance D satisfying Equation (13) on both sides of the high potential electrode.

EXAMPLE 3

The size of the luminous spot in the Y direction was measured with the image-forming apparatus having a picture device shown in FIG. 6.

The apparatus was produced in the same manner as in Example 1.

In FIG. 6, the face plate 8 was placed 3 mm above the substrate 1 with a supporting frame (not shown in the drawing). A driving voltage $V_f$ of 14 V was applied between the device electrodes so as to give high potential to the device electrode 2 by the device driving power source 10 to emit electrons from the electron emitting region 4, and an accelerating voltage of 6 KV was applied to the fluorescent member 7 by the electron beam accelerating power source 11 through the transparent electrode 6. The electron-emitting region 4 had a length L of 150 μm in the Y direction.

In this state, the size $S_2$ of the luminous spot 9 in the Y direction on the fluorescent member on the image forming member was measured visually with a microscope at a magnification of about 50×. The size $S_2$ was found to be about 650 μm.

According to Equation (12), $$\begin{aligned} S_2 &= 150\ (\mu\text{m}) + 2\Delta Y \\ &= 150\ (\mu\text{m}) + 2 \times K_4 \times 2 \times 3000\ (\mu\text{m}) \times \\ &\quad (14/6000)^{1}/2 \end{aligned}$$

$K_4$=0.8–0.9, therefore $S_2$=614 (μm)×671 (μm). In this Example also, the experimentally measured size agrees satisfactorily with this calculated value.

EXAMPLE 4

Figure 7:
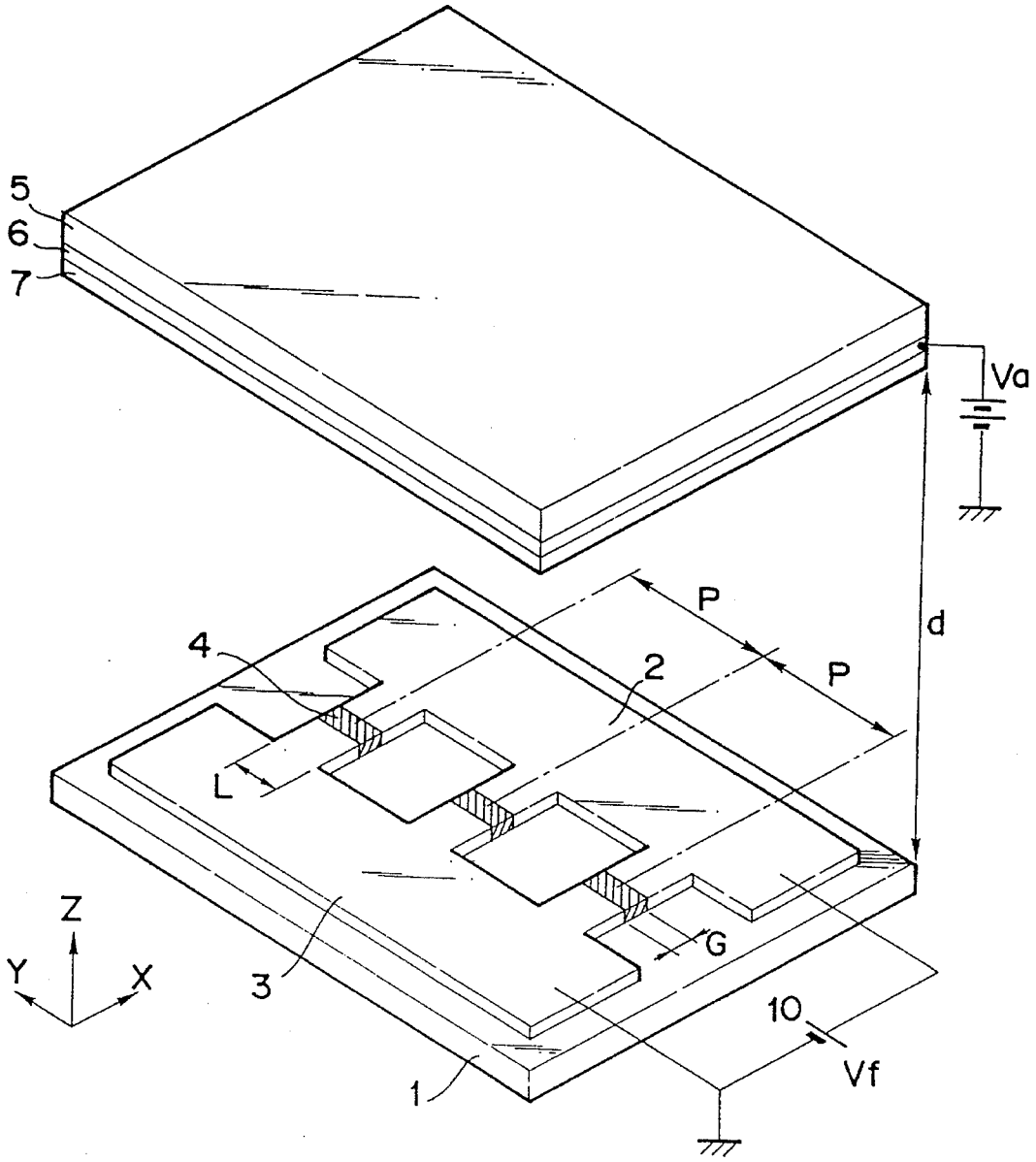
FIG. 7 is a perspective view illustrating a picture device construction of an image-forming apparatus in Example 4 of the present invention.

FIG. 7 is a perspective view of a portion of an image-forming apparatus of this Example, in which a number of electron emitting devices are arranged in the Y direction.

The apparatus was produced in the same way as in Example 1. Therefore the method of production thereof is not described here. In this Example, a number of electron-emitting devices are arranged at an arrangement pitch P=500 μm in a perpendicular direction to the voltage application direction, namely in Y direction.

A driving voltage $V_f$ of 14 V was applied between the device electrodes so as to give high potential to the device electrode 2 by the device driving power source 10 to emit electrons from the electron emitting region 4, and an accelerating voltage of 6 KV was applied to the fluorescent member 7 by the electron beam accelerating power source 11 through the transparent electrode 6.

Figure 8:
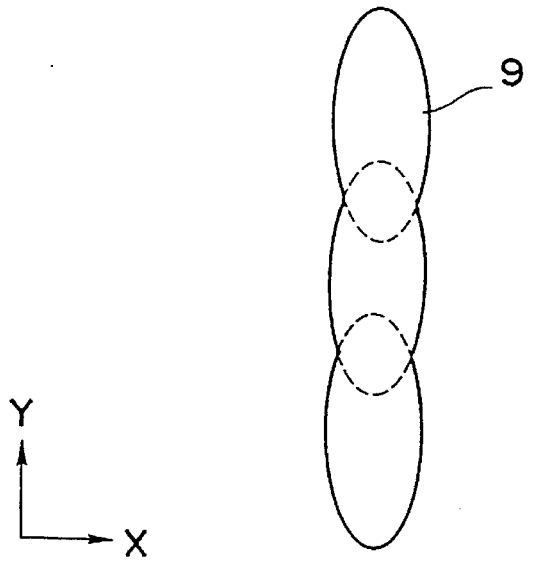
FIG. 8 illustrates a shape of a luminous spot observed in the image forming apparatus in Example 4 of the present invention.
Figure 9:
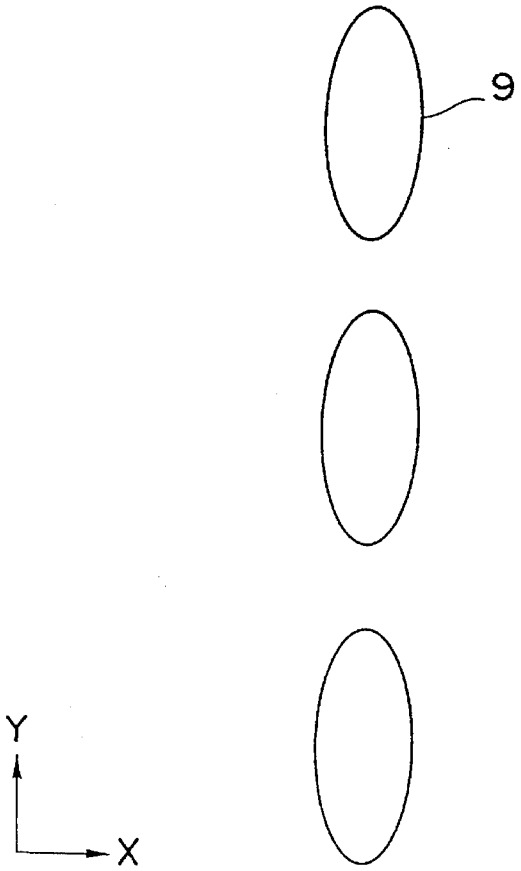
FIG. 9 illustrates a shape of a luminous spot observed in image forming apparatus in the Example 5 of the present invention.

The distance d between the inside face of the face plate 8 and the substrate 1 having the electron-emitting devices was 3 mm. In this case, according to Equation (12), the luminous spot size $S_2$ in the Y direction is calculated to be at least 614 μm. In this Example, the arrangement pitch of the devices was 500 μm. Therefore, the luminous spots on the fluorescent member overlapped with each other in the Y direction as shown in FIG. 8, so that the spots looked like a continuous line, making the displayed image continuous. Thus this forming apparatus is particularly suitable for display of animations.

EXAMPLE 5

An image forming apparatus was produced in the same manner as in Example 4 except that the electron-emitting devices were arranged at an arrangement pitch P of 800 μm perpendicular to the voltage application direction, namely in the Y direction. In this Example, the arrangement pitch P of the devices in the Y direction is larger than the maximum spot size of 671 μm in the Y direction. Therefore, the luminous spots on the fluorescent member was observed to be completely separated, so that the formed image was distinct and sharp, being particularly suitable for forming letters or the like.

EXAMPLE 6

Figure 10:
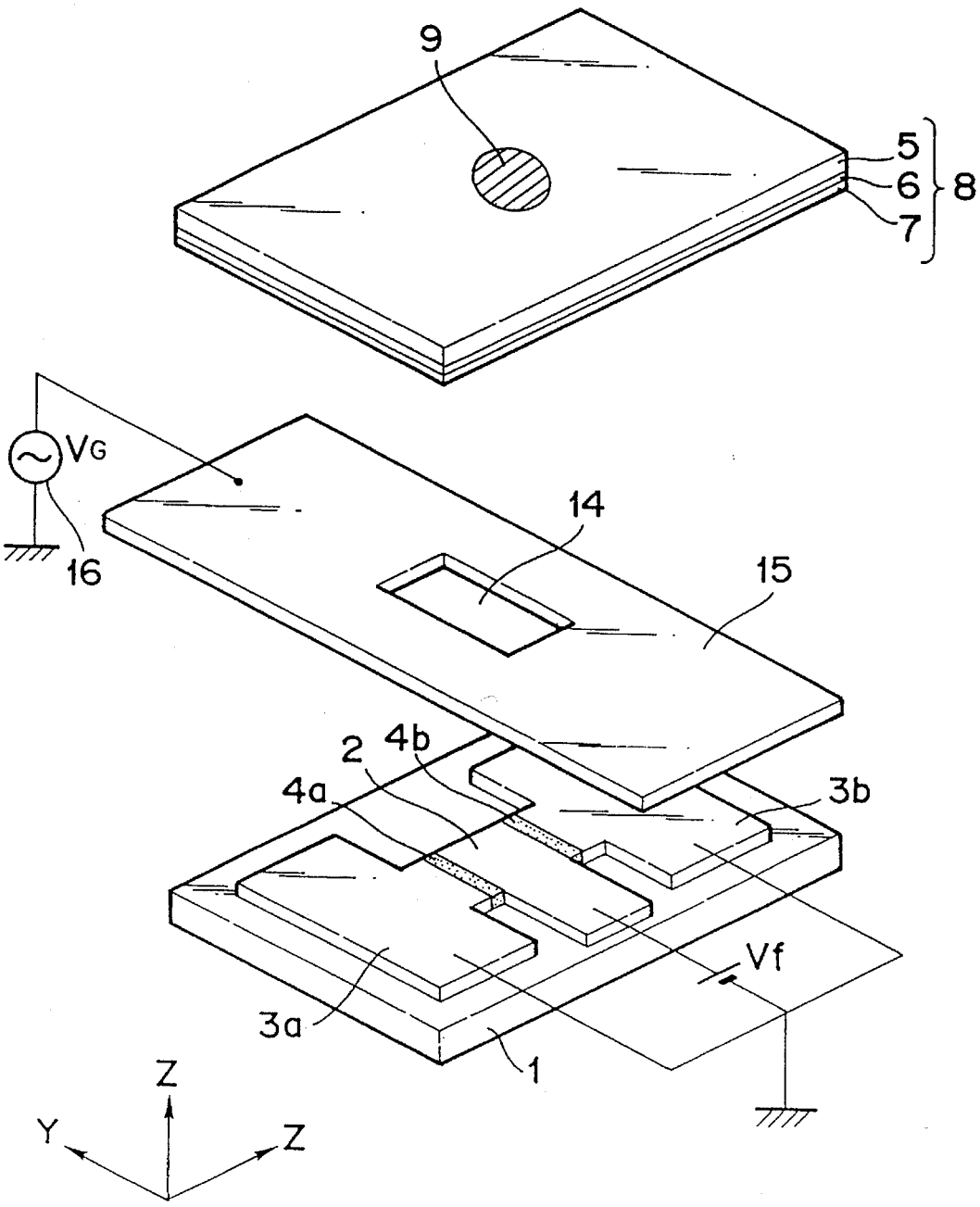
FIG. 10 is a perspective view illustrating constitution of a picture device of an image forming apparatus in Example 6 of the present invention.
Figure 11:
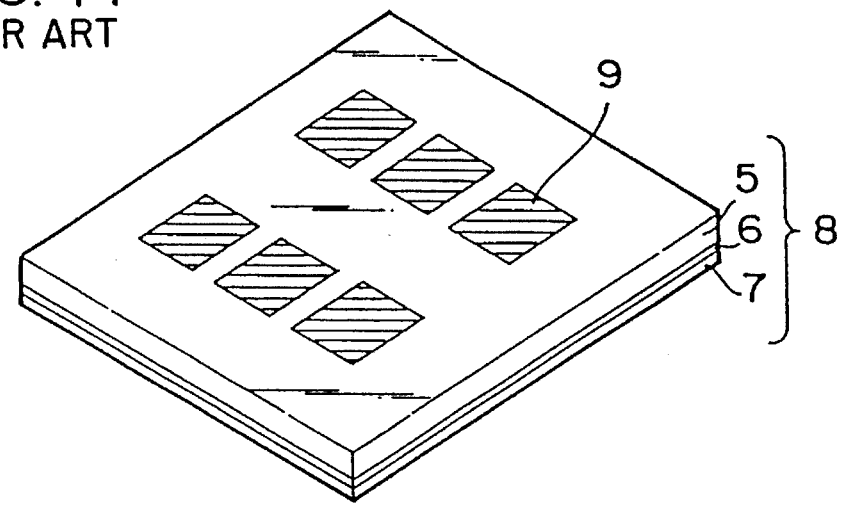
FIG. 11 PRIOR ART
FIG. 11 illustrates a conventional image-forming apparatus employing thermoelectron sources.
Figure 11:
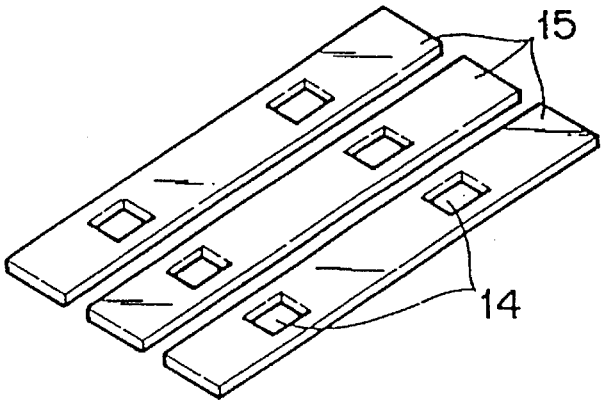
FIG. 11 PRIOR ART
Figure 11:
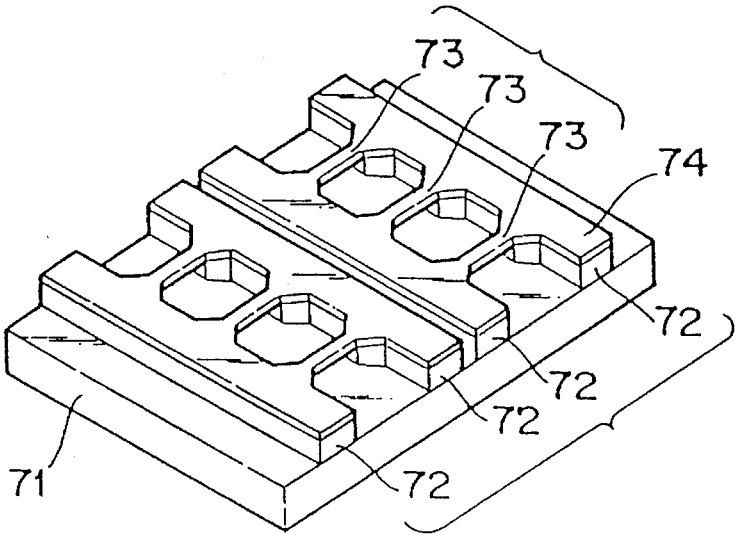
FIG. 11 PRIOR ART
Figure 12:
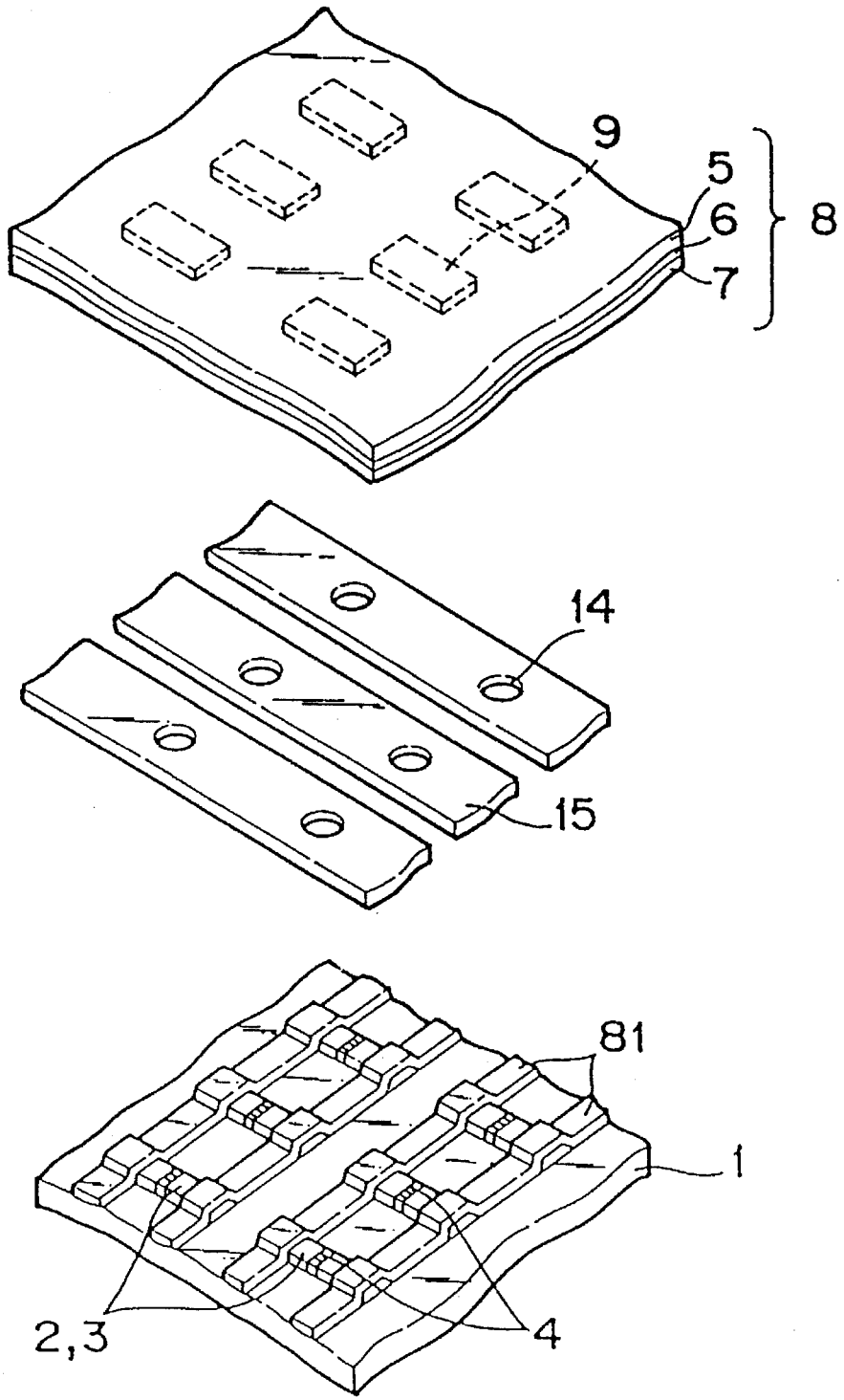
FIG. 12 PRIOR ART
FIG. 12 illustrates a conventional image-forming apparatus employing surface conduction type electron-emitting devices.

An image-forming apparatus of the present invention was produced, having a construction as shown in FIG. 10. The surface conduction electron-emitting devices were formed in the same manner as in Example 2. In this Example, a modulation electrode 15 was placed between the substrate 1 and the face plate 8. Voltage $V_G$ was applied to the modulation electrode 15 by a power source 16 in correspondence with information signals to control the quantity of the electron beam projected from the electron-emitting device to the fluorescent member 7.

In this Example, the modulation electrode 15 controls the electron beam to be projected to the fluorescence member 7 (ON state) or to be cut off (OFF state). Therefore, in the image-forming apparatus of this Example, the shape of the electron beams or of the luminous spots is not affected by the variation of the modulation voltage $V_G$, and the luminous spots are not distorted or not made non-uniform, unlike the case in 10 which shape of the electron beams (or of luminous spots) is controlled by the modulation voltage $V_G$.

As described above, even with an image-forming apparatus having modulation electrodes, luminous spots are obtained in a non-distorted symmetric shape and a sharp display image was obtained.

The present invention relates to a image-forming apparatus employing surface conduction electron-emitting devices or employing electron-emitting devices in which electrons are emitted by application of voltage between electrodes formed in a plane shape on a substrate. In such an image-forming apparatus, the size of the electron beam spots can be calculated as a function of the voltage applied to the devices, acceleration voltage, and a distance between the devices and the image-forming member according to the present invention. Thereby the image-forming apparatuses can readily be designed to be suitable for application fields such as animation application fields and letter forming field, and image-forming apparatus can be produced which is capable of giving high quality of display.

Furthermore, with the image-forming apparatus of the present invention, the beam spots are improved to be symmetric and non-distorted in shape, thereby an image being obtained with improved resolution, distinctness, and sharpness advantageously.

The image-forming apparatus of the present invention will possibly be useful widely in public and industrial application fields such as high-definition TV picture tubes, computer terminals, large-picture home theaters, TV conference systems, TV telephone systems, and so forth.

What is claimed is:

1. An image-forming apparatus comprising:

a substrate;

an electron-emitting device provided on said substrate, said electron emitting device having an electron-emitting region between first and second electrodes and emitting electrons on application of a voltage between said electrodes; and an image-forming member which forms an image on irradiation of an electron beam, wherein a diameter $S_1$ of the electron beam on said image-forming member in a direction of application of the voltage between said electrodes is given by Equation (I):

$$S_1=K_1\cdot 2d(V_f/V_a)^{1/2} \quad \text{(I)},$$

where $K_1$ is a constant and $0.8 \leqq K_1 \leqq 1.0$, d is a distance between said substrate and said image-forming member, $V_f$ is a voltage applied between said electrodes, and $V_a$ is a voltage applied to said image-forming member.

2. The image-forming apparatus according to claim 1, further comprising a plurality of said electron-emitting devices, and electron beams emitted from respective electron-emitting regions form one picture element on said image-forming member.

3. The image-forming apparatus according to claim 2, wherein said plurality of electron emitting regions are placed between a pair of low voltage electrodes with interposition of a high potential electrode.

4. The image-forming apparatus according to claim 3, wherein the distance D between said plurality of electron-emitting regions in a voltage application direction satisfies Equation (II):

$$K_2\cdot 2d(V_f/V_a)^{1/2} \geqq D/2 \geqq K_3\cdot 2d(V_f/V_a)^{1/2} \quad \text{(II)}$$

$$K_2=1.25\pm0.05,$$

and $$K_3=0.35\pm0.05$$

5. The image-forming apparatus according to any of claims 1 to 4, wherein said electron-emitting device is a surface conduction electron-emitting device.

6. The image-forming apparatus according to any of claims 1 to 4, wherein said electron-emitting device and the image-forming member respectively have independent voltage application means.

7. The image-forming apparatus according to any of claims 1 to 4, further comprising modulation means for modulating the electron beam emitted from said electron-emitting device in accordance with an information signal.

8. An image-forming apparatus comprising:

a substrate;

an electron-emitting device provided on said substrate, said electron-emitting device having an electron-emitting region between first and second electrodes and emitting electrons on application of a voltage between said electrodes; and an image-forming member which forms an image on irradiation of an electron beam, wherein a diameter $S_2$ of the electron beam on said image-forming member in a direction perpendicular to the direction of application of the voltage between said electrodes is given by Equation (III):

$$S_2=L+2K_4\cdot 2d(V_f/V_a)^{1/2} \quad \text{(III)},$$

where $K_4$ is a constant and $0.8\leqq K_4\leqq 0.9$, d is a distance between said substrate and said image-forming member, L is the length of said electron-emitting region perpendicular to the direction of voltage application, $V_f$ is a voltage applied between said electrodes, and $V_a$ is a voltage applied to said image-forming member.

9. The image-forming apparatus according to claim 8, wherein a plurality of said electron-emitting devices are placed on said substrate.

10. The image-forming apparatus according to claim 8, wherein a diameter $S_1$ of an electron beam on said image-forming member in a direction of application of the voltage between said electrodes is given by Equation (I)

$$S_1=K_1\cdot 2d(V_f/V_a)^{1/2} \quad \text{(I)},$$

where $K_1$ is a constant and $0.8\leqq K_1\leqq 1.0$, d is a distance between said substrate and said image-forming member, $V_f$ is a voltage applied between said electrodes, and $V_a$ is a voltage applied to said image-forming member.

11. The image-forming apparatus according to claim 10, further comprising has a plurality of said electron-emitting devices, and electron beams emitted from respective electron-emitting regions form one picture element on said image-forming member.

12. The image-forming apparatus according to claim 11, wherein said plurality of electron emitting regions are placed between a pair of low voltage electrodes with interposition of a high potential electrode.

13. The image-forming apparatus according to claim 12, wherein a distance D between said plurality of electron-emitting regions in a voltage application direction satisfies Equation (II):

$$K_2\cdot 2d(V_f/V_a)^{1/2}\geqq D/2\geqq K_3\cdot 2d(V_f/V_a)^{1/2} \quad \text{(II)}$$

$$K_2=1.25\pm 0.05,$$

and $$K_3=0.35\pm 0.05$$

14. The image-forming apparatus according to any of claims 8 to 13, wherein said electron-emitting device is a surface conduction electron-emitting device.

15. The image-forming apparatus according to any of claims 8 to 13, wherein said electron-emitting device and said image-forming member respectively have an independent voltage application means.

16. The image-forming apparatus according to any of claims 8 to 13, further comprising a modulation means for modulating the electron beam emitted from said electron-emitting device in accordance with an information signal.

17. An image-forming apparatus comprising:

a substrate;

a plurality of electron-emitting devices provided on said substrate, each electron-emitting device having an electron-emitting region between first and second electrodes and emitting electrons on application of a voltage between said respective electrodes; and an image-forming member which forms an image on irradiation of an electron beam, wherein said electron-emitting devices are arranged at an arrangement pitch P in a direction perpendicular to voltage application between said electrodes, and the pitch P satisfies Equation (IV):

$$P<L+2K_5\cdot 2d(V_f/V_a)^{1/2} \quad \text{(IV)},$$

where $K_5=0.80$, d is a distance between said substrate and said image-forming member, L is the length of said electron-emitting region in a direction perpendicular to the direction of voltage application, $V_f$ is a voltage applied between said electrodes, and $V_a$ is a voltage applied to said image-forming member.

18. The image-forming apparatus according to claim 17, wherein said electron-emitting devices are surface conduction electron-emitting devices.

19. The image-forming apparatus according to claim 17, wherein said electron-emitting devices and said image-forming member respectively have an independent voltage application means.

20. The image-forming apparatus according to claim 17, further comprising modulation means for modulating the electron beam emitted from said electron-emitting device in accordance with an information signal.

21. An image-forming apparatus comprising:

a substrate;

a plurality of electron-emitting devices provided on said substrate, each said electron emitting device having an electron-emitting region between first and second electrodes and emitting electrons on application of a voltage between said respective electrodes; and an image-forming member which forms an image on irradiation of an electron beam, wherein said electron-emitting devices are arranged at an arrangement pitch P in a direction perpendicular to voltage application between said electrodes, and the pitch P satisfies Equation (V):

$$P\geqq L+2K_6\cdot 2d(V_f/V_a)^{1/2} \quad \text{(V)},$$

where $K_6=0.90$, d is a distance between said substrate and said image-forming member, L is the length of said electron-emitting region perpendicular to the direction of voltage application, $V_f$ is a voltage applied between said respective electrodes, and $V_a$ is a voltage applied to said image-forming member.

22. The image-forming apparatus according to claim 21, wherein said electron-emitting devices are surface conduction electron-emitting device.

23. The image-forming apparatus according to claim 21, wherein said electron-emitting devices and said image-forming member respectively have an independent voltage application means.

24. The image-forming apparatus according to claim 21, further comprising modulation means for modulating the electron beam emitted from said electron-emitting device in accordance with an information signal.

25. A method for forming an image-forming apparatus comprising the steps of:

providing a substrate with an electron-emitting device provided on the substrate and including an electron-emitting region between electrodes and for emitting electrons on application of a voltage between the electrodes, and an image-forming member which forms an image on irradiation of an electron beam; and designing a diameter $S_1$ of the electron beam at the image-forming member face in direction of application of the voltage between the electrodes to satisfy Equation (I):

$$S_1=K_1\cdot 2d(V_f/V_a)^{1/2} \quad \text{(I)},$$

where $K_1$ is a constant and $0.8 \leqq K_1 \leqq 1.0$, d is a distance between the substrate and the image-forming member, $V_f$ is a voltage applied between the electrodes, and $V_a$ is a voltage applied to the image-forming member.

26. A method for forming an image-forming apparatus comprising the steps of:

providing a substrate with an electron-emitting device provided on the substrate and an electron-emitting region between electrodes and emitting electrons on application of a voltage between the electrodes, and an image-forming member which forms an image on irradiation of an electron beam; and designing a diameter $S_2$ of the electron beam at the image-forming member face perpendicular to the direction of application of the voltage between the electrodes to satisfy Equation (III):

$$S_2=L+2K_4\cdot 2d(V_f/V_a)^{1/2} \quad \text{(III)},$$

where $K_4$ is a constant and $0.8 \leqq K_4 \leqq 0.9$, d is a distance between the substrate and the image-forming member, L is the length of the electron-emitting region perpendicular to the direction of voltage application, $V_f$ is a voltage applied between the electrodes, and $V_a$ is a voltage applied to the image-forming member.

27. The method for forming an image forming apparatus according to claim 26, further comprises the step of designing a diameter $S_1$ of the electron beam at the image-forming member face in a direction of application of the voltage between the electrodes to satisfy Equation (I):

$$S_1=K_1\cdot 2d(V_f/V_a)^{1/2} \quad \text{(I)},$$

where $K_1$ is a constant and $0.8 \leqq K_1 \leqq 1.0$, d is a distance between the substrate and the image-forming member, $V_f$ is a voltage applied between the electrodes, and $V_a$ is a voltage applied to the image-forming member.

28. An image-forming apparatus of any of claims 1 to 4, wherein the image-forming apparatus is used as a television picture tube.

29. An image-forming apparatus of any of claims 8 to 13, wherein the image-forming apparatus is used as a television picture tube.

30. An image-forming apparatus of any of claims 17 to 20, wherein the image-forming apparatus is used as a television picture tube.

31. An image-forming apparatus of any of claims 21 to 24, wherein the image-forming apparatus is used as a television picture tube.

32. An image-forming apparatus of any of claims 1 to 4, wherein the image-forming apparatus is used as a computer terminal.

33. An image-forming apparatus of any of claims 8 to 13, wherein the image-forming apparatus is used as a computer terminal.

34. An image-forming apparatus of any of claims 17 to 20, wherein the image-forming apparatus is used as a computer terminal.

35. An image-forming apparatus of any of claims 21 to 24, wherein the image-forming apparatus is used as a computer terminal.

* * * * *

UNITED STATES PATENT AND TRADEMARK OFFICE

CERTIFICATE OF CORRECTION

PATENT NO. : 5,455,597

DATED : October 3, 1995

INVENTOR(S) : Nakamura et al.

It is certified that error appears in the above-indentified patent and that said Letters Patent is hereby corrected as shown below:

COLUMN 2:

Line 36, "in an use for" should read --for use in an--.

COLUMN 3:

Line 2, "10" should be deleted.
Line 60, "$K_2 2d(V_f/V_a)^{1/2} D/2 \leq K_3 \cdot 2d(V_f/N_a)^{1/2}$.....(II) should read --$K_2 \cdot 2d(V_f/V_a)^{1/2} \geq D/2 \geq K_3 \cdot 2d(V_f/N_a)^{1/2}$.....(II)--.

COLUMN 6:

Line 66, "voltage $V_a$" should read --voltage $V_f$--.

COLUMN 7:

Line 13, "in" should read --in the--.
Line 20, "10" should be deleted.
Line 39, "$\Delta X_o = 2d\{C(V_f)/V_a)^{1/2}$.....(2)" should read --$\Delta X_o = 2d\{C(V_f/V_a\}^{1/2}$.....(2).
Line 67, "$\{(C+v_o)(V_f)\}^{1/2} = K_3(V_f)^{1/2}$" should read --$\{(C-v_o)(V_f)\}^{1/2} = K_3(V_f)^{1/2}$--.

COLUMN 8:

Line 47, "$\{(\Delta X_1^2 - \Delta X_2^2)/2\{^{1/2} = 2d(v_o/V_a)^{1/2}$.....(9)" should read --$\{(\Delta X_1^2 - \Delta X_2^2)/2\}^{1/2} = 2d(v_o/V_a)^{1/2}$.....(9)--.

UNITED STATES PATENT AND TRADEMARK OFFICE

CERTIFICATE OF CORRECTION

PATENT NO. : 5,455,597

DATED : October 3, 1995

INVENTOR(S) : Nakamura et al.

It is certified that error appears in the above-indentified patent and that said Letters Patent is hereby corrected as shown below:

Line 56, "$K_4=\{(K_2^2-K_3^2)/2)^{1/2}$" should read --$K_4=\{(K_2^2-K_3^2)/2\}^{1/2}$--.

COLUMN 9:

Line 3, ".80$\leq K_4 \leq$0.90" should read --0.80$\leq K_4 \leq$0.90--.
Line 30, "$K_2 \cdot 2d(V_f/V_a)^{1/2} \geq D/2 \geq K_3 \cdot 2d(V_f V_a)^{1/2}$.....(13)" should read --$K_2 \cdot 2d(V_f/V_a)^{1/2} \geq D/2 \geq K_3 \cdot 2d(V_f/V_a)^{1/2}$.....(13)--.

COLUMN 11:

Line 6, "a" should be deleted.

COLUMN 12:

Line 8, "Y: 650 μm." should read --Y: 650 μm).--.
Line 43, "(14/6000)1/2" should read --14/6000)$^{1/2}$--.
Line 45, "$S_2$=614 (μm)x671 (μm)." should read --$S_2$=614 (μm) - 671 (μm).

COLUMN 13:

Line 45, "10" should be deleted.

COLUMN 14:

Line 47, "$K_3$=0.35±0.05" should read --$K_3$=0.35±0.05.--.
Line 53, "the" should read --said--.

UNITED STATES PATENT AND TRADEMARK OFFICE

CERTIFICATE OF CORRECTION

PATENT NO. : 5,455,597

DATED : October 3, 1995

INVENTOR(S) : Nakamura et al.

It is certified that error appears in the above-indentified patent and that said Letters Patent is hereby corrected as shown below:

COLUMN 15:

Line 29, "has" should be deleted.
Line 47, "$K_3$=0.35±0.05" should read --$K_3$=0.35±0.05.--.
Line 57, "a" should be deleted.

Signed and Sealed this

Fourth Day of June, 1996

Bruce Lehman

*Attest:*

BRUCE LEHMAN

*Attesting Officer*

*Commissioner of Patents and Trademarks*